United States Patent [19]

Cacak

[11] Patent Number: 4,623,101

[45] Date of Patent: Nov. 18, 1986

[54] FILAMENT TENSIONER

[75] Inventor: Harold L. Cacak, Lincoln, Nebr.

[73] Assignee: Brunswick Corporation, Skokie, Ill.

[21] Appl. No.: 634,276

[22] Filed: Jul. 25, 1984

[51] Int. Cl.[4] ..... B65H 59/38; B65H 63/024

[52] U.S. Cl. ..... 242/45; 242/37 R; 318/459

[58] Field of Search ..... 242/45, 36, 75.5, 75.51, 242/156.2, 37 R; 254/275, 362; 318/6, 362, 368, 375, 381, 459, 474, 476, 477

[56] References Cited

U.S. PATENT DOCUMENTS

| | | | |
|---|---|---|---|
| 2,844,773 | 7/1958 | Turner et al. | 242/45 X |
| 2,966,315 | 12/1960 | Pegram | 242/156.2 |
| 2,981,491 | 4/1961 | Eans, Jr. | 242/45 |
| 3,101,912 | 8/1963 | Bartlett | 242/156.2 X |
| 3,371,878 | 3/1968 | Garner | 242/45 |

*Primary Examiner*—Stanley N. Gilreath

*Attorney, Agent, or Firm*—Wood, Dalton, Phillips, Mason & Rowe

[57] ABSTRACT

A filament tensioner for controlling the tension of filament or roving as it is wound onto an article includes means for sensing the tension in the filament as it is being transferred from a spool and means coupled to the tension sensing means for adjusting the output torque of a motor which drives the spool to in turn maintain the filament tension at a desired value. The tension sensing means includes a pivoted arm, a roller rotatably coupled to an end of the pivoted arm, the roller being engaged by the filament so that the pivoted arm is pivoted to a position determined by the tension in the filament and means for generating a position signal representing the position of the pivoted arm. In the preferred embodiment, the position signal is utilized by a pulse width modulated drive system to control the output torque of the motor.

12 Claims, 8 Drawing Figures

FILAMENT TENSIONER

TECHNICAL FIELD

The present invention relates generally to filament winding apparatus and more particularly to a tensioner for automatically controlling the tension in a filament or roving as it is delivered from or to a spool.

BACKGROUND OF THE INVENTION

Various manufacturing processes involve winding of filaments or roving onto manufactured articles. The need for higher winding speeds, more consistent winding operations from part to part, and the complexity of the shapes onto which the filament or roving is to be wound have contributed to the need for more accurate control over the tension of the filament or roving.

In the past, filament tension control has been accomplished by textile-type tensioners which have been found poorly suited to achieve the above-noted objects. In particular, these types of tensioners do not allow bidirectional control of filament tension, and hence there is not compensation for high filament accelerations.

Hydraulic motor tensioning systems have been found to function quite well in these applications; however, they are quite costly, difficult to install and, due to the hydraulic supply and connecting lines, highly immobile.

One prior attempt to overcome the above limitations involved the use of a microprocessor to control a permanent magnet DC motor by means of pulse width modulation techniques. This tension control system utilized filament tension sensing apparatus, such as a gray code encoder, potentiometer or other position transducer to sense the tension in the filament and to develop a signal representative of same. This signal was coupled to the microprocessor which operated a pulse width modulator and transistor bridge circuitry to in turn control the torque of the motor and hence the tension in the filament.

The tension sensing apparatus included a roller engaged by the filament, the roller being movable along a linear path with the tension in the filament determining the position of the roller along the linear path. The roller was in turn coupled to a wire rope and spring with the wire rope engaging the transducer to cause an actuator thereof to rotate as the roller moved along the linear path. An indication of filament tension was thereby obtained at the output of the transducer.

This system also included means for detecting breakage of the filament which included means for detecting when the position transducer output indicated filament tension outside of a predetermined range on either side of a set point. If such an event occurred the motor was de-energized to allow the situation to be rectified.

It was found that the microprocessor-based system described above was overly large and expensive.

Furthermore, the means for detecting filament breakage operated in a less than optimal fashion. In particular, the set point could be adjusted to a relatively low level which would in turn prevent motor deenergization even if filament tension dropped to zero. Furthermore, there was no means to prevent motor shutoff in the event of a relatively short tension excursion. Finally, particularly in situations where the filament was guided by pulleys or other guiding apparatus through a resin impregnation bath and then onto the article, if filament breakage occurred in the vicinity of the article, the tensioner motor would reverse and operate at near maximum speed against the friction introduced by the guiding apparatus and bath in an attempt to maintain filament tension at the desired value. This action would cause the impregnated filament to be wound back onto the non-impregnated filament before the motor is stopped.

SUMMARY OF THE INVENTION

In accordance with the present invention, a filament tensioner accurately controls filament tension at a desired value, yet is smaller and roughly half as expensive as previous systems. The tensioner includes tension sensing means for sensing the tension in the filament including a pivoted arm which is movable to a plurality of positions and a roller rotatably disposed on the arm and engaged by the filament so that the pivoted arm is moved to a position determined by the tension in the filament. Means are included for generating a position signal representing the position of the pivoted arm. Means coupled to the position sensing means adjusts the output torque of a motor in accordance with the position signal to in turn maintain filament tension at a desired value.

Means are also provided for sensing when the voltage at one terminal of the motor has exceeded a particular level for more than a predetermined length of time to in turn sense filament breakage, in which case the motor is de-energized. This type of filament breakage sensing means does not suffer from the disadvantages noted with respect to the previous tensioner.

DESCRIPTION OF THE PREFERRED EMBODIMENT

Figure 1:
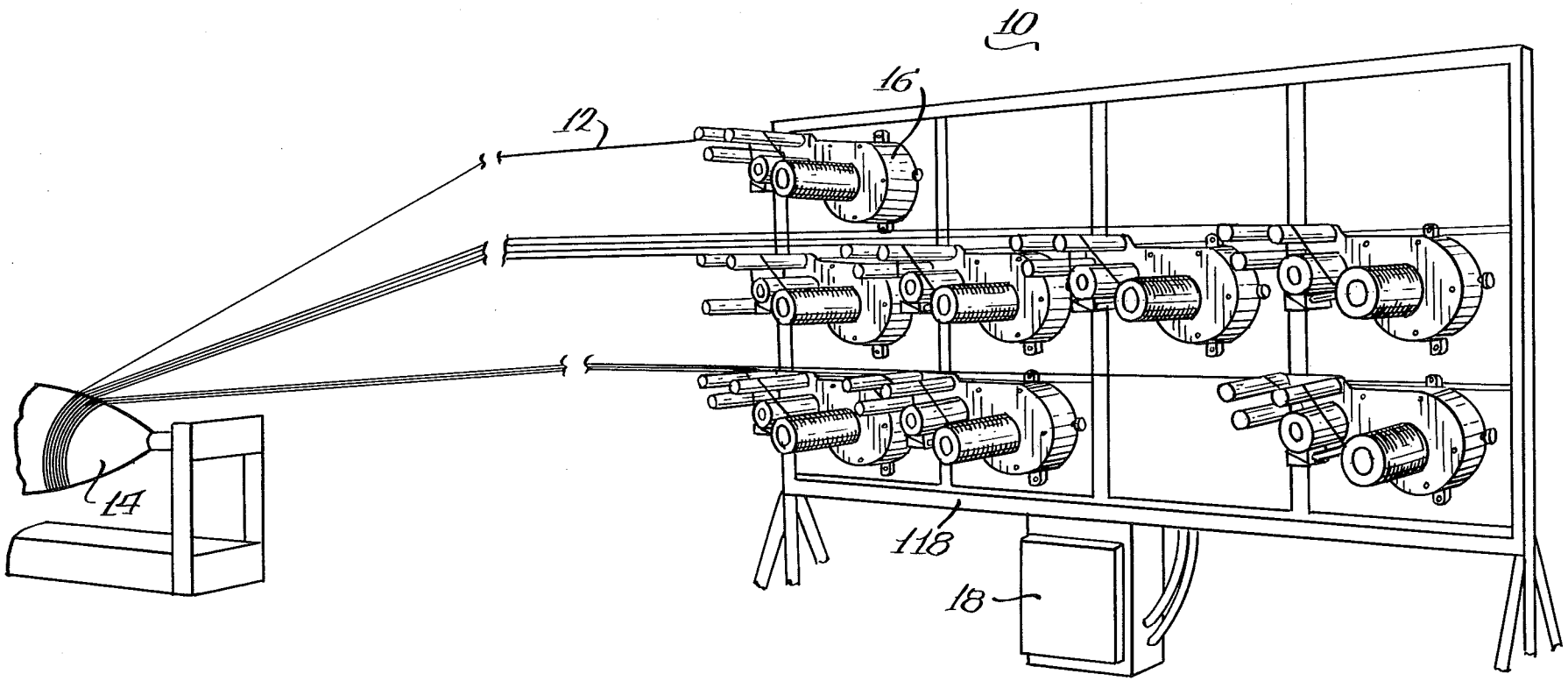
FIG. 1 is a perspective view of a filament winding system having a plurality of filament tensioners according to the present invention.

Referring now to FIG. 1, there is illustrated a filament winding system 10 for winding strands of filament or roving 12 about an object or article, such as a pressure vessel 14. The winding system 10 includes a plurality of filament tensioners, such as tensioner 16, the tensioners coupled to a control panel 18 which contains contactors for controlling the application of power to the tensioners.

The filament or roving 12 is pulled off of the tensioners 16 by rotation or other movement of the article 14, the tensioners 16 introducing a controlled amount of drag on the filament to in turn control the tension therein.

Figure 2:
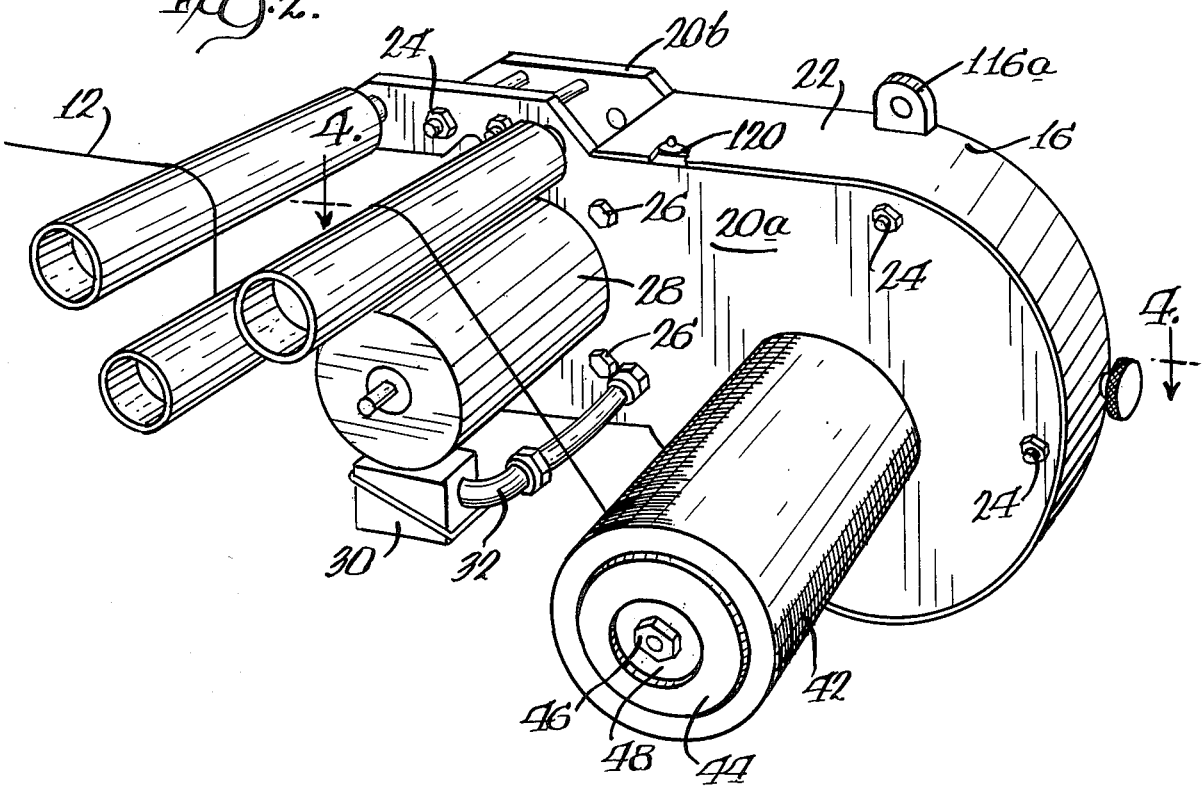
FIG. 2 is an enlarged perspective view of one of the filament tensioners shown in FIG. 1.

Referring now to FIG. 2, each filament tensioner 16 includes first and second cover plates 20*a*,20*b* which are secured to each other and to base 22 by means of threaded rods 24. The cover plates and base together comprise a housing for the tensioner 16.

The cover plates 20*a*,20*b* are interchangeable to allow the filament or roving 12 to be delivered from either side of the base 22.

Figure 3:
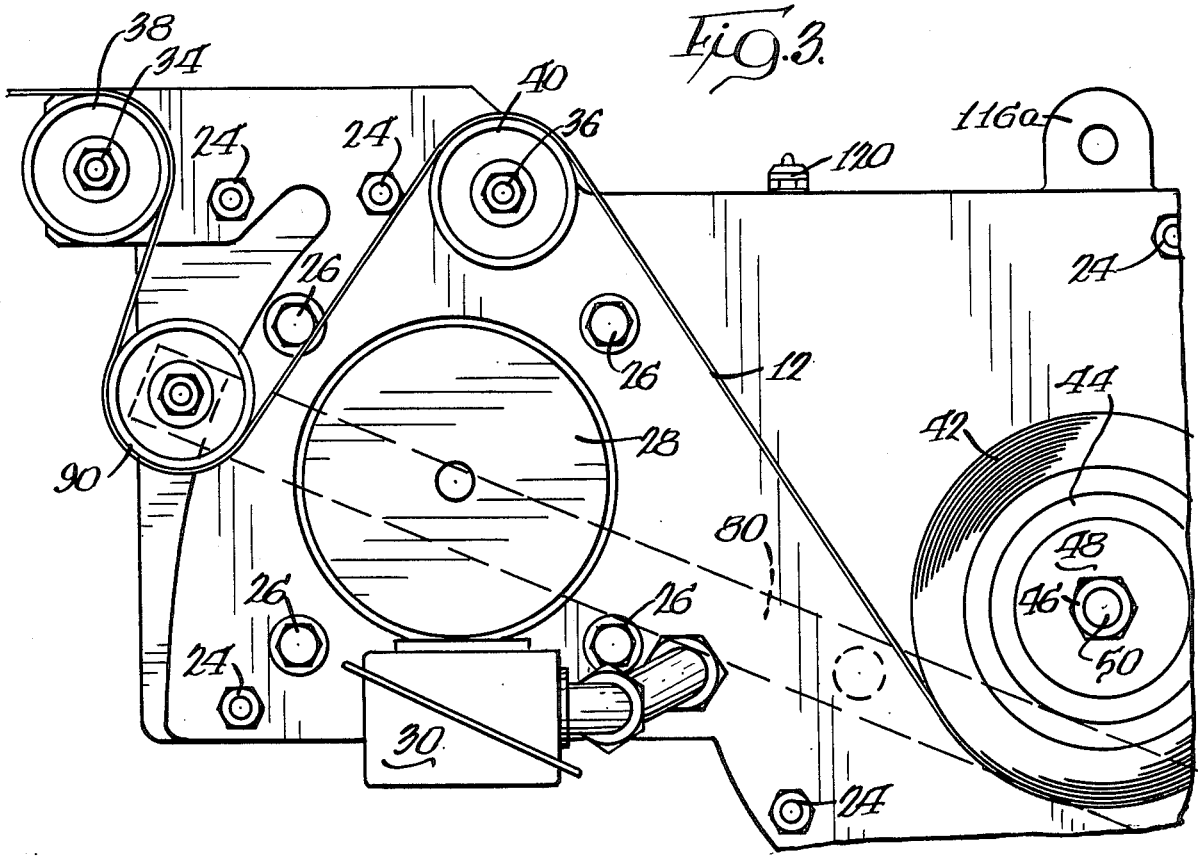
FIG. 3 is a fragmentary elevational view of the filament tensioner shown in FIG. 2.

Referring also to FIG. 3, secured to the cover plate 20*a* by means of four bolts 26 is a motor 28 which, in the preferred embodiment, is of the permanent magnet DC type which develops variable output torque in either of first and second directions. An armature lead connection box 30 is mounted on the cover plate 20*a* by means of conduit 32 through which the motor armature leads extend.

Also secured to the cover plate 20*a* is a pair of fixed spindles 34,36 over each of which is disposed a rotatable sleeve or roller 38,40, respectively. The filament or roving 12 passes over and causes rotation of the sleeve or roller 38,40 as the filament 12 is wound onto or unwound from a spool 42.

Figure 4:
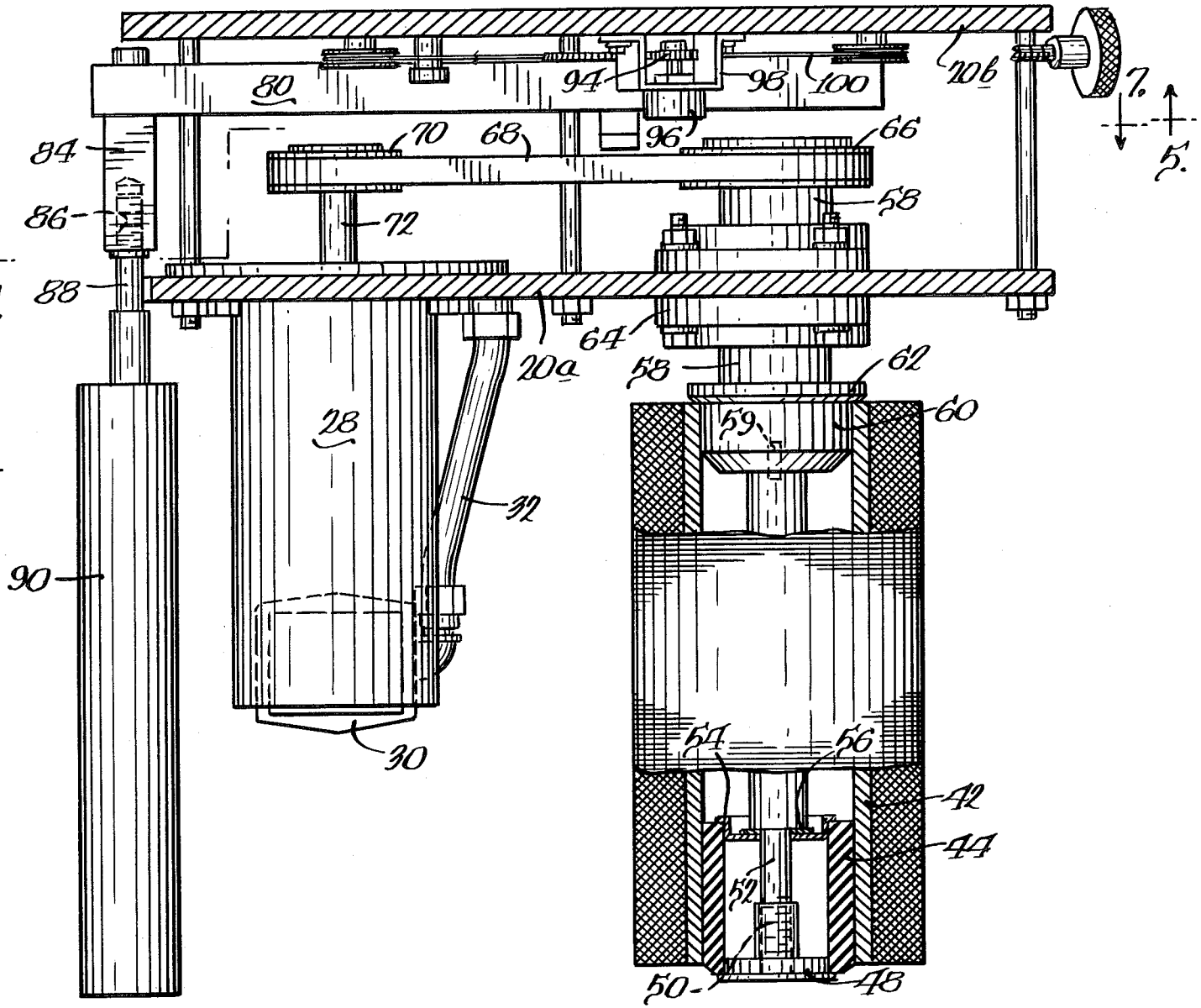
FIG. 4 is a sectional view taken along the lines 4—4 of FIG. 2.

The spool 42 is frictionally engaged about its inner periphery by an elastomeric sleeve 44, seen in greater detail in FIG. 4 which, in the preferred embodiment, is made of natural rubber. The sleeve 44 is joined by means of a nut 46 and a flanged cap 48 onto a threaded portion 50 of a drive spindle 52. A second flanged cap 54 seated within the sleeve 44 bears against a shoulder 56 of the drive spindle 52 and maintains the sleeve 44 in position thereon.

Elastomeric sleeve 44 normally has an outer diameter which is slightly less than the inner diameter of the spool 42. Once the spool 42 is placed over the sleeve 44, the nut 46 is tightened to expand the outer diameter of the sleeve 44 to thereby capture the spool thereon and cause the two to move as a unit.

The drive spindle 52 includes a portion comprising a drive shaft 58. The drive shaft 58 is coupled in driving relationship by means of a key 59 to a flange collar 60. A main body of the collar 60 has an outer diameter approximately equal to the inner diameter of the spool 42 so that the collar 60 and the sleeve 44 together maintain the spool in a fixed position relative to the drive shaft 58. A flange 62 limits axial travel of the spool relative to the shaft 58 and the spindle 52.

Figure 7:
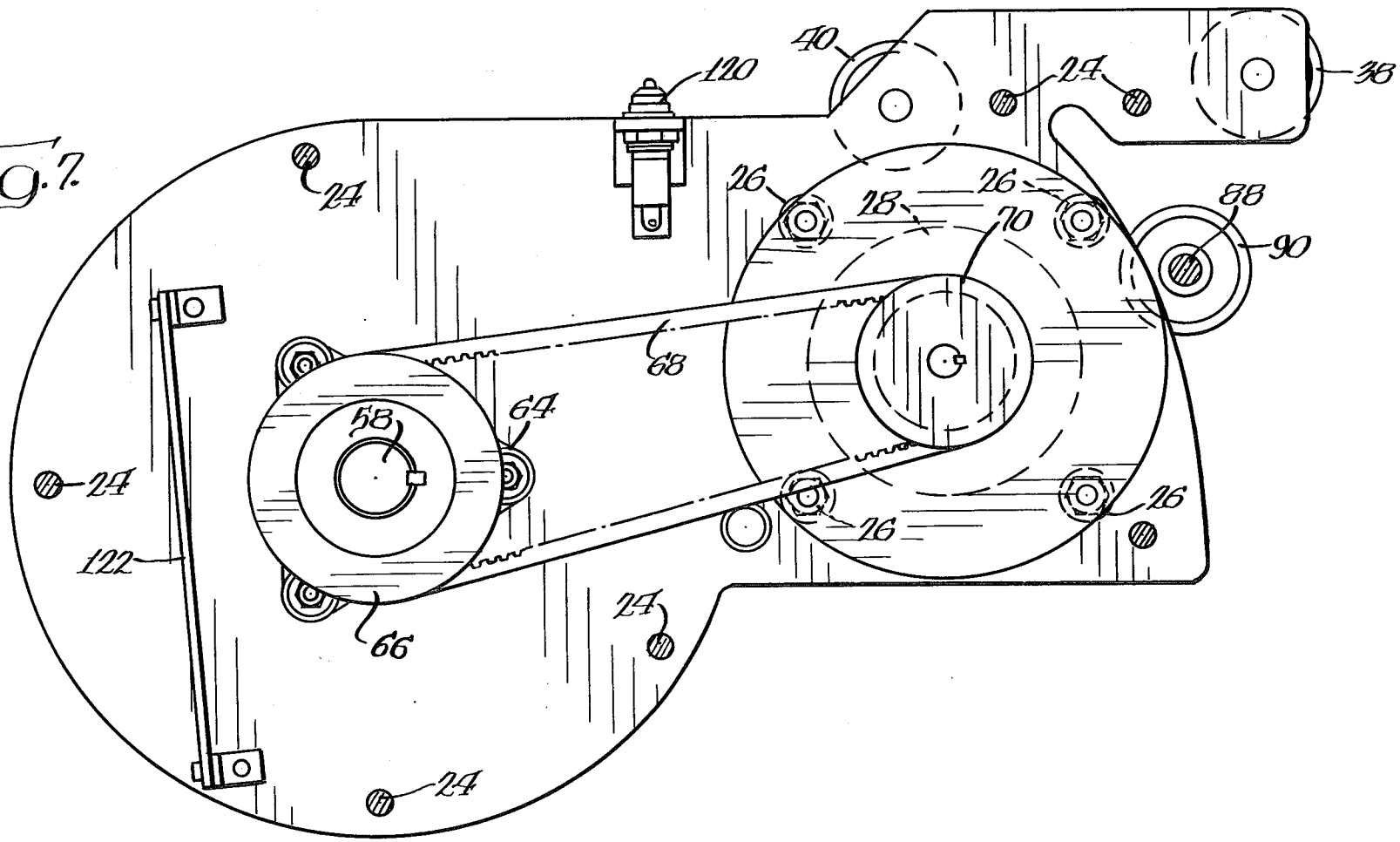
FIG. 7 is a sectional view taken generally along the lines 7—7 of FIG. 4.

The drive shaft 58 extends through a pair of bearings 64 disposed on either side of a hole in the cover plate 20*a* into the space between the plates 20*a*, 20*b*. Referring also to FIG. 7, a pulley 66 is disposed on the end of the drive shaft 58, the pulley 66 being engaged by a toothed timing belt 68 which is in turn engaged by a pulley 70 disposed on an output shaft 72 of the motor 28.

Figure 5:
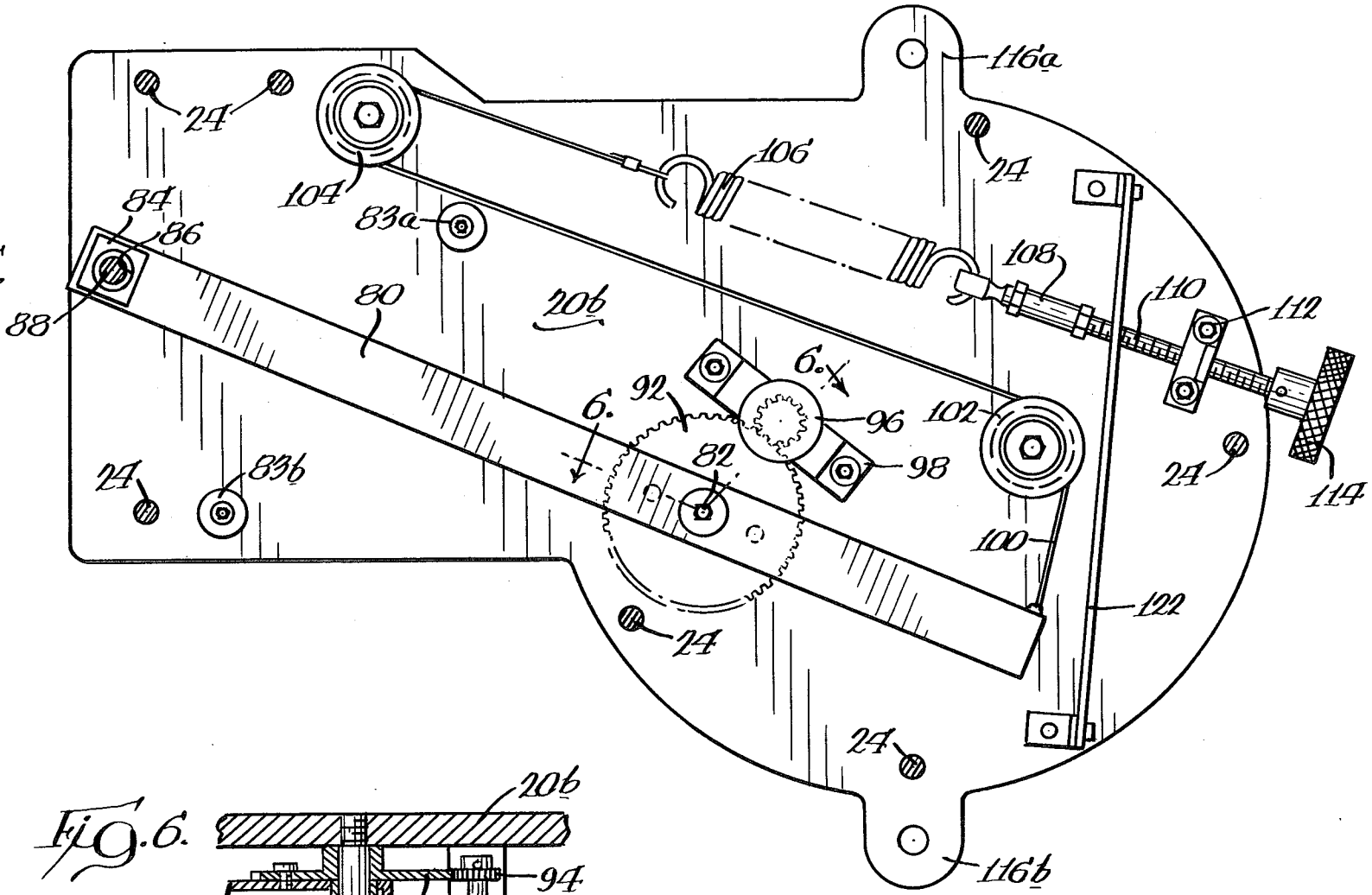
FIG. 5 is a sectional view taken along the lines 5—5 of FIG. 4.

Referring specifically to FIGS. 4 and 5, rotatable means in the form of a pivoted arm 80 is rotatably secured by means of a pin 82 to the cover plate 20*b*. Referring specifically to FIG. 5, the pivoted arm 80 is rotatable about the pin 82 between stops 83*a*,83*b*. A spindle support 84 is secured to one end of the pivoted arm 80 and includes a bore 86 into which is threaded a spindle 88. Disposed on the spindle 88 is a sleeve or roller 90 which is free to rotate thereon.

Figure 6:
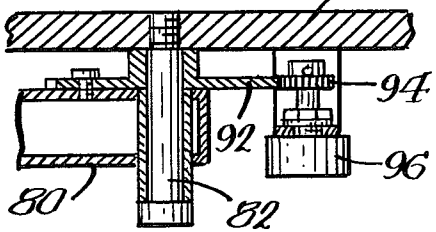
FIG. 6 is a sectional view taken generally along the lines 6—6 of FIG. 5.

Referring specifically to FIGS. 4–6, the pivoted arm 82 is bolted to a first toothed gear 92 which engages a second toothed gear 94 mounted on the actuator or shaft of a potentiometer 96. The potentiometer 96 is in turn mounted on the cover plate 20*b* by means of a strap 98.

Secured to another or second end of the pivoted arm 80 opposite the end carrying the spindle 88 is a wire rope 100. The wire rope 100 extends around rotatable pulleys 102, 104 to a spring 106. The spring 106 is in turn connected to spring preload adjustment means comprising a hooked anchor 108, a threaded rod 110, a rod support 112 having a threaded bore through which the rod 110 extends and a preload adjustment knob 114 disposed on the end of the rod 110. The preload adjustment means can be utilized to adjust the spring force exerted by the spring 106 on the wire rope 100, as noted more specifically below.

Referring again to FIGS. 2 and 3, the filament 12 extends from the spool 42 over the sleeve or roller 40, under the sleeve or roller 90 disposed on the end of the pivoted arm 80, over the roller 38 disposed on the spindle 34 and thence to the pressure vessel 14. The tension in the filament 12 rotates the pivoted arm 80 about the pin 82 and upwardly away from the stop 83*b*, FIG. 5, to an equilibrium position at which the spring force set by the preload adjusting means comprising the elements 108–114 is balanced by the oppositely-acting force developed by the tension in the filament. In the preferred embodiment, the potentiometer output is adjusted to a zero level when the filament tension is at the desired level. When the tension in the filament subsequently varies from the desired level, the pivoted arm rotates, such rotation being transmitted to the potentiometer 96 which in turn develops a position output signal indicative of the placement of the arm relative to the original equilibrium position. This position signal is utilized as a feedback signal to control motor torque, and hence filament tension, as noted more specifically below.

The filament tensioner 16 therefore includes tension sensing means for sensing the tension in the filament 12, such means including the roller 90, spindle 88, pivoted arm 80, gears 92,94 and potentiometer 96.

As seen in FIGS. 2 and 5, mounting lugs 116*a*, 116*b* are provided on upper and lower portions of the base 22 to permit the filament tensioner 16 to be mounted on a stand 118, FIG. 1. In addition, a circuit breaker 120, FIGS. 3 and 7, may be provided to protect the electrical components of the tensioner 16 in the event of a short circuit.

Figure 8:
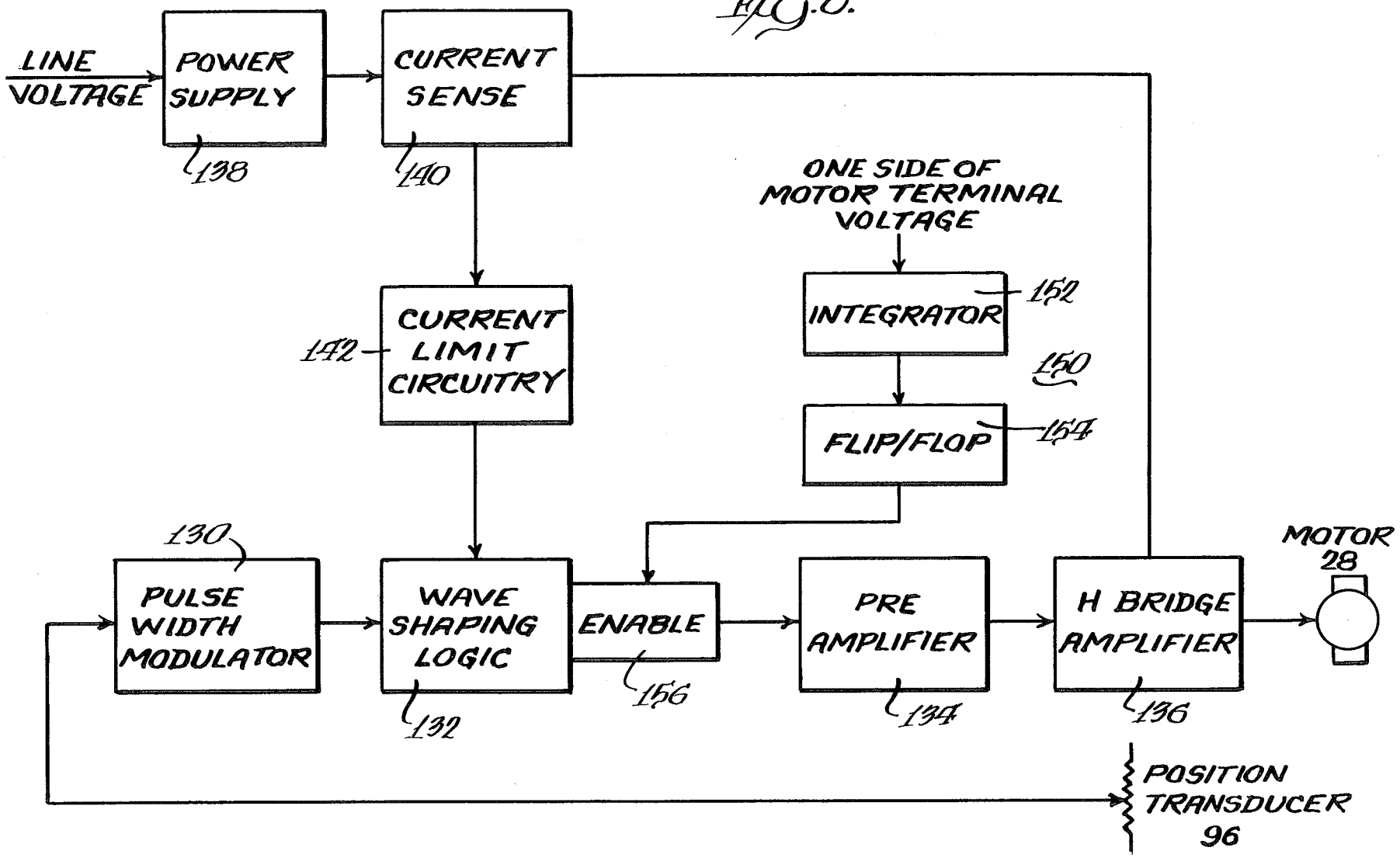
FIG. 8 is a block diagram of an electrical circuit for controlling the torque of the motor shown in FIGS. 1–7.

The operation of the tensioner 16 will now be described in conjunction with the block diagram of FIG. 8. Several of the electrical components shown in block diagram form in FIG. 8 are disposed on a printed circuit, or PC board 122 seen in FIGS. 5 and 7. Additional components may be mounted on the cover plate 20*a*, as desired.

As seen in FIG. 8, the position signal from the potentiometer 96 is coupled to a pulse width modulator 130 which develops a pulse width modulated (or PWM) wave having a pulse width dependent upon the signal from the potentiometer 96. The pulse width modulated wave is coupled to wave-shaping logic 132 which modifies the output from the pulse width modulator 130. The output from the wave-shaping logic 132 is coupled through a pre-amplifier 134 to motor drive circuitry in the form of an H-bridge amplifier 136. The H-bridge 136 is in turn coupled to and controls the voltage delivered to the armature windings of the motor 28. The circuits 130, 132, 134 and 136 together comprise a controlled voltage source of the motor 28.

The wave-shaping logic 132 provides a short delay between positive and negative transitions of the pulse width modulated wave from the circuit 130 to prevent the H-bridge amplifier from shorting out supply power received from a power supply 138. The wave-shaping logic 132 also operates in conjunction with a current sensing circuit 140 and a current limiting circuit 142 to prevent the pulse width of the pulse width modulated wave from exceeding a specified limit which could cause an overcurrent condition in the H-bridge 136.

Referring also to FIG. 1, as the filament 12 is pulled off the spool 42 by rotation or other movement of the pressure vessel 14, the motor exerts a controlled drag on the filament 12 to maintain the tension at a desired value. The tension in the filament 12 is sensed by the potentiometer 96, as noted above, and the motor is controlled by the circuits shown in FIG. 8 to produce torque which is transmitted to the spool in a direction which opposes the payout of filament 12 in the event the tension is too low or which aids the payout of filament 12 in the event that the tension is too high. If the tension is at the desired value, as detected by the pivoted arm 80 being at the equilibrium position, the motor torque remains unchanged.

In essence, when the arm 80 is below the equilibrium position, indicating that the tension in the filament 12 is below the desired value, the motor is controlled by the pulse width modulator 130 and the circuitry represented by the blocks 132,134,136 to develop torque in a direction which opposes the direction of rotation of the spool 42. As seen in FIG. 3, this torque is in a counterclockwise direction which opposes the clockwise rotation of the spool 42. This applied torque in turn increases the tension in the filament 12 and causes the arm 80 to rotate toward the equilibrium position.

At some point in the winding process, it may occur that movement of the pressure vessel 14 increases the tension in the filament 12. This may be due to a discontinuity in the winding pattern, by a sudden increase in speed of movement of the pressure vessel 14 or by another cause. When this occurs, the arm 80 rotates in a clockwise direction as viewed in FIG. 3 away from the equilibrium position. In this event, the position transducer 96 generates a signal which is coupled to the pulse width modulator 130 and the circuitry represented by the blocks 132,134,136 to cause the motor to develop torque in a direction which aids the rotation of the spool 42, i.e. the clockwise direction as viewed in FIG. 3. This developed torque lowers the tension in the filament 12 so that the arm 80 returns to the equilibrium position.

In effect, it can be seen that the motor may either provide torque in the same direction as the direction of rotation of the spool 42 when filament tension is above the desired value or may provide dynamic braking to the spool 42 when filament tension is below the desired value.

It can also be seen that such operation allows the inertia of the spool and friction in the various rotating elements to be taken into account, since such factors will be reflected in the tension of the filament 12 and hence the position of the arm 80. The motor will thereby be controlled to overcome such inertia and friction to maintain the filament tension at the desired level.

It should be noted that the motor is rarely operated such that it rotates in a direction opposite to that which occurs as filament is being pulled off the spool 42. However, as noted more specifically below, short periods of motor operation in a direction which causes takeup of filament 12 on the spool 42 is permitted, if necessary, to accommodate certain winding patterns.

The circuitry shown in FIG. 8 also includes novel circuitry 150 for determining whether the motor has been subjected to a step removal of load caused by breakage of the filament 12. The circuitry 150 senses one side of the motor terminal armature voltage and, if this voltage exceeds a predetermined limit for greater than a particular time, then the source of controlled voltage is disabled to de-energize the motor 28.

The circuitry 150 includes an integrator 152 having an input which is coupled to one armature terminal of the motor 28. This motor terminal, when the filament or roving is being transferred from the spool 42, is typically considered the "return" or ground terminal of the motor.

The integrator 152 is in turn coupled to a flip flop 154. The flip flop 154, when the filament or roving is not broken, generates an enable signal which is coupled to an enable circuit 156 which, although in reality a part of the wave-shaping logic 132, is shown as a separate structure for purposes of clarity. The enable circuit 156 permits the output of the wave-shaping logic 132 to pass to the amplifiers 134 and 136 when the output of the flip flop 154 is in a first state and blocks the output of the wave-shaping logic 132 when the flip flop output is in a second state.

Should the filament or roving 12 break, the back emf of the motor will rise, in turn causing the voltage at the terminal connected to the integrator 152 to also rise. The integrator integrates this voltage over time, causing an increasing signal to appear at the output of the inegrator. When the inreasing output of the integrator 152 reaches a predetermined level, the flip flop 154 will be reset, in turn causing an output signal to be generated by the flip flop which will instruct the enable circuit 156 to prevent the pulse width modulated wave from being passed to the amplifiers 134, 136. Hence, the motor drive will cease and the motor 28 will come to a stop.

The time constant of the integrator 152 is selected to permit short periods of roving takeup, which action may be necessary for certain winding patterns. Furthermore, the time constant is selected to be long enough to permit a short period of operation in the reverse direction to allow the generation of negative torque for dynamic braking so that compensation is made for the inertia of the spool 42.

The filament breakage sensing means permits relatively short tension excursions without motor deenergization. The desired filament tension may also be set to a relatively low level without the problem of continued motor energization in the event of zero filament tension. Furthermore, the motor will be stopped in the event of filament breakage before the filament is completely rewound back onto the spool.

The circuitry and apparatus shown in the figures comprises a closed loop system wherein the desired amount of tension in the filament may be adjusted by suitable adjustment of the tension adjusting means comprising the elements 106–114 shown in FIG. 5. Should the tension in the filament 12 attempt to vary from the desired tension, the position transducer comprising the potentiometer 96 develops a signal which causes the pulse width modulator 130 to vary the motor torque and thereby maintain the tension at the proper value.

Modifications may be effected to the circuitry of FIG. 8 without departing from the scope of the invention. For example, other types of amplifier arrangements may be substituted for the H-bridge amplifier 136. Furthermore, a linear drive for the motor 28 can be substituted for the pulse width modulated drive shown in the figures. Also, the potentiometer 96 may be replaced by other types of position transducers which are capable of sensing the position of the pivoted arm 80.

The filament tensioner of the present invention allows more accurate tension control over a wider range than currently available units. Additionally, due to the elimination of friction brakes and the replacement thereof by dynamic braking, the reliability of the instant filament tensioner is increased as compared to a mechanical tension control.

I claim:

1. A filament tensioner for controlling the tension of filament transferred between an article and a spool, comprising:

a low inertia permanent magnet DC motor having at least two terminals coupled to a source of controlled voltage energizable to provide variable torque to the spool in either of first and second directions;

means for sensing the tension in the filament as the filament is delivered including rotatable means coupled to the filament and rotatable to a position determined by the filament tension and means for developing a position signal representing the position of the rotatable means;

means coupled to the tension sensing means for controlling the motor torque magnitude and direction in dependence upon the position signal to in turn maintain the filament tension at a desired value; and means for detecting breakage of the filament including means for sensing whether the voltage at one of the terminals has risen above a certain level for more than a particular length of time and means for responsive to the detecting means for de-energizing the motor when filament breakage occurs.

2. The filament tensioner of claim 1, wherein the sensing means comprises an integrator and wherein the detecting means further includes a flip flop coupled to the integrator for developing a signal which assumes a certain state when the integrator reaches a predetermined level.

3. The filament tensioner of claim 2, wherein the de-energizing means comprises means for disabling the source of controlled voltage when the flip flop signal assumes the certain state.

4. A tensioner for controlling the tension of a filament stored on a spool as it is transferred to an object, the spool being driven by a motor having at least two terminals coupled to a source of controlled voltage wherein the motor develops output torque, comprising:

tension sensing means for sensing the tension in the filament including a pivoted arm, a roller engaged by the filament rotatably coupled to one end of the pivoted arm, the roller being engaged by the filament so that the pivoted arm is pivoted to a position determined by the tension therein and a position transducer for generating a position signal representing the position of the pivoted arm;

means coupled to the position transducer for adjusting the output torque of the motor in accordance with the position signal to in turn maintain the filament tension at a desired value; and means for detecting breakage of the filament including means for sensing whether the voltage at one of the terminals has risen above a certain level for more than a particular length of time and means responsive to the detecting means for de-energizing the motor when filament breakage occurs.

5. The tensioner of claim 4, wherein the sensing means comprises an integrator and wherein the detecting means further includes a flip flop coupled to the integrator for developing a signal which assumes a certain state when the integrator reaches a predetermined level.

6. The tensioner of claim 5, wherein the de-energizing means comprises means for disabling the source of controlled voltage when the flip flop signal assumes the certain state.

7. A motor control for controlling a motor energizable to drive a load and having at least two terminals coupled to a source of controlled voltage, the motor being subject to a step removal of the load, comprising:

an integrator coupled to one of the terminals for integrating the terminal voltage over time, the terminal voltage being substantially equal to zero when the load is driven by the motor and being a voltage substantially greater than zero following the step removal of load; and means coupled to the integrator for disabling the source of controlled voltage when the output of the integrator reaches a predetermined level to in turn deenergize the motor.

8. The motor control of claim 7, further including a flip flop coupled between the integrator output and the disabling means.

9. The motor control of claim 7, wherein the integrator has a time constant which is selected to compensate for the inertia of the load.

10. The motor control of claim 7, wherein the load comprises a quantity of filament wound on a spool driver by the motor and wherein the integrator has a time constant of a duration which permits dynamic braking to be effected by the motor to compensate for the inertia of the spool.

11. In a control for a filament tensioner including a spool having filament stored thereon, a motor coupled to the spool and energizable at at least two terminals by a source of controlled voltage to transfer the filament under tension from the spool to an object, an improved circuit for controlling the motor in the event of breakage of the filament, comprising:

means for sensing breakage of the filament including an integrator coupled to one of the terminals for integrating the terminal voltage over time, the terminal voltage being close to zero when the filament is unbroken and being a voltage substantially greater than zero following breakage of the filament; and means coupled to the sensing means for disabling the source of controlled voltage when the integrator output reaches a predetermined level.

12. The improved circuit of claim 11, wherein the sensing means further includes a flip flop coupled between the integrator output and the disabling means.

* * * * *